US006378703B1

(12) United States Patent
Mathur et al.

(10) Patent No.: US 6,378,703 B1
(45) Date of Patent: Apr. 30, 2002

(54) FLOTATION METHOD FOR REMOVING COLORED IMPURITIES FROM KAOLIN CLAY

(75) Inventors: Sharad Mathur, Macon; Ronnie E. Brooks, Gordon; Ernest M. Finch, Macon, all of GA (US)

(73) Assignee: Engelhard Corporation, Iselin, NJ (US)

( * ) Notice: Subject to any disclaimer, the term of this patent is extended or adjusted under 35 U.S.C. 154(b) by 0 days.

(21) Appl. No.: 09/727,322

(22) Filed: Nov. 30, 2000

(51) Int. Cl.[7] ..... B03D 1/02; B03D 1/01
(52) U.S. Cl. ..... 209/166; 106/486; 501/148
(58) Field of Search ..... 209/166, 167; 106/486; 501/148

(56) References Cited

U.S. PATENT DOCUMENTS 2,990,958 A 7/1961 Greene et al. ..... 209/166
4,483,624 A 11/1984 Bacon, Jr. et al. ..... 366/292
4,492,628 A 1/1985 Young et al. ..... 209/5
4,629,556 A 12/1986 Yoon et al. ..... 209/166
5,522,986 A * 6/1996 Shi et al.
5,810,998 A * 9/1998 Arrington-Webb et al.
5,997,625 A 12/1999 Londo et al. ..... 106/486
6,007,618 A * 12/1999 Norris et al.
6,145,667 A * 11/2000 Rothenberg et al.
6,200,377 B1 * 3/2001 Basilio et al.

* cited by examiner

*Primary Examiner*—Thomas M. Lithgow
(74) *Attorney, Agent, or Firm*—Stephen I. Miller

(57) ABSTRACT

An improved method for purifying titania contaminated kaolin clay by froth flotation which features the use an hydroxamate flotation collector at a neutral or mildly alkaline pH wherein a slurry of the impure clay is conditioned for the flotation step in a baffled conditioning apparatus provided with mean for imparting sufficient mechanical energy to heat a dispersed slurry of the impure clay before flotation.

12 Claims, No Drawings

FLOTATION METHOD FOR REMOVING COLORED IMPURITIES FROM KAOLIN CLAY

FIELD OF THE INVENTION

This invention relates an improved method for purifying titania contaminated kaolin clay by froth flotation which features the use an hydroxamate flotation collector at a neutral or mildly alkaline pH wherein a slurry of the impure clay is conditioned for the flotation step in a baffled conditioning apparatus provided with mean for imparting sufficient mechanical energy of a dispersed slurry of the impure clay before flotation.

BACKGROUND OF THE INVENTION

Froth flotation has been widely used on an industrial scale to separate various mineral particles from other particles in an aqueous mineral pulp based on differences in mineral species. The processing generally depends upon adding reagents that selectively attach to mineral particles to be floated, whereby the particles with attached reagent(s) have a greater affinity for air bubbles than other particles and can be removed as a froth. The step conventionally used in the art to describe the step(s) prior to aeration and, hence, flotation, is referred to as "conditioning" Material(s) added to selectively attach to a desired species is referred to as the "collector." In the case of oxide and/or silicate minerals, the collector is usually anionic, exemplified by, but not limited to, fatty and/or resin acids. In many cases of oxide and/or silicate flotation, polyvalent ions, usually calcium are used to promote "collector coating" of the mineral to be floated. Frequently, frothers are added. Obviously pH control must be applied. Since the products processed by froth flotation are frequently industrial minerals, the economics of the processing is of prime significance. Economics is affected, among other factors, by the sharpness of separation, the extent of recovery of valued mineral and energy requirements, including but not limited to costs incurred during removal of water.

When froth flotation is applied to separate large oxide or silicate mineral particles, e.g., particles large than 20 microns, the processing can be relatively straight forward. However, when froth flotation is used with "slimed" ore pulps, i.e., ore pulps that contain sub-micron size particles, the processing becomes more difficult. Among other reasons, slimes tend to attach to particles to be floated and the desired selectively is relatively difficult to achieve. A prime example of a slimed ore pulp that presents unique difficulties in practicing froth flotation is the flotation purification of kaolin clay wherein the objective is to remove a colored, anatase (titania) impurity from the kaolin clay, resulting in a purified kaolin product of materially increased brightness value. In such case, the flotation of coarse particle size fractions of kaolin clay ores was readily achieved over 50 years ago by simple anionic (negative ion) flotation using a fatty acid collector and selected sulfate salts. However, when slimes were present, as they were when using whole kaolin crudes or fine particles size fractions of crudes, the desired selectivity for titania flotation, achieved at a commercially feasible recovery of purified clay, was difficult to achieve. Among the reasons for the difficulty, was the necessity to physically separate the mineral particles before the aeration and flotation step. This necessitated the use of controlled amounts of clay dispersants to assure physical separation of slimed particles from other particles. However, reagents used as aids to collector coating, such as sources of polyvalent cations, e.g., calcium ions, tended to conflict with operation of clay dispersants. On the other hand, clay dispersants that were too powerful (for example, condensed phosphate salts) tended to interfere with the action of collectors and adjuvant flotation oils. The generation of froths that were sufficiently strong to endure the mechanical forces of aeration and flotation also presented technical obstacles.

Thus, while the froth flotation purification of kaolin clays is one of the most widely practiced industrial mineral operations, there has been an ongoing need to improve the effectiveness and economics of the operation. Among the prime inventions heretofore utilized to purify kaolin clay on a commercial basis is the "Ultraflotation" process described in U.S. Pat. No. 2,990,958, Greene et al, commonly assigned. Briefly, a particulate calcite reagent was employed with a fatty acid and selected flotation oils to remove titania from a dispersed pulp of a fine fraction the impure clay. A characteristic of the processing was that the purified kaolin was recovered as a dilute, e.g., 10% solids aqueous pulp, that was subsequently dewatered. Another commercially practiced process is referred to as "TREP" (an acronym for "titania removal and extraction process"). In this process, conditioning was conducted in a "squirrel cage" conditioner using a fatty acid collector and a calcium or iron salt. This was followed by addition of an acrylate salt dispersant. Reference is made to U.S. Pat. No. 4,492,628, Young et al. Conditioning was carried out in a baffled, high intensity mill referred to as "squirrel cage." See U.S. Pat. No. 4,483,624 Bacon et al. A drawback of TREP is that the high intensity conditioning is time intensive and adds significantly to the cost of the processing. Also, equipment wear adds to costs. Efforts to reduce conditioning time have resulted in inadequate purification and/or undesirably low recovery of purified kaolin clay.

In addition to fatty acids used as anionic collectors for oxide flotation, anionic hydroxamates have been advocated. The use of hydroxamate in clay flotation is described in U.S. Pat. No. 4,629,559, Yoon et al and allegedly has the advantage of not requiring the use of salt activators such as calcium salts. Initial attempts to substitute an hydroxamate for the fatty acid/salt activator system used commercially in practice of the TREP process were not promising. The low recovery and less than desired degree of purification was due to foaminess resulting probably from high pH (9–10) and excessive temperatures (200° F. or higher) generated during conditioning. Initially, it was speculated that the hydroxamate reagent would not be stable at the high temperatures used in TREP flotation.

SUMMARY OF THE INVENTION

An object of the present invention is to improve TREP flotation of kaolin clay.

In accordance with this invention an anionic hydroxamate collector is used in TREP flotation to remove selectively the titania impurity from kaolin clay. Operation of the process of the invention, while making use of an hydroxamate collector, necessitates significant departures from parameters advocated in the prior art for flotation purification of kaolin using an hydroxamate collector. Specifically, the pH of the flotation pulp is significantly lower than those advocated in the prior art. Much more energy is used in the conditioning step when practicing conventional TREP flotation using a fatty acid collector.

The substitution of hydroxamate for the oleic acid-calcium chloride reagents of the prior art led to unexpected results. The most surprising result was that the anatase removal improved with decreasing pH, in contrast to the prior art directed to the use of hydroxamate collector. The optimum pH for attachment of the hydroxamate to titania has been reported to be at least pH 8.5 in the prior art. At pH 7.0 titania removal does occur but not to the optimum level as at pH 10.0 recommended by Yoon et al (U.S. Pat. No. 4,629,556). There was substantial removal of anatase at pH 7.0 compared to pH 10.0 with increase in conditioning time. Another novel aspect of hydroxamate conditioning using the TREP conditioner is that the temperature generated can be as high as 170° F. without adversely affecting the flotation performance.

It was also observed that the conditioning time could be reduced by 75% by substituting the Ca-oleic acid reagent system with hydroxamate in the TREP process. With 35% conditioning solids the residence time in the TREP conditioner with hydroxamate is about 20 minutes compared to 80 minutes with the Ca-oleic acid reagent chemistry. These residence times correspond to temperatures of 130° F. and 200° F. In fact, the flotation response in terms of brightness improvement and TiO2 remaining in the product appeared to increase with conditioning temperatures up to 170° F.

It is estimated that implementation of the hydroxamate reagent scheme will reduce the conditioning time in a TREP plant by at least 50% and conditioner temperature by at least 30 deg. F. which will result in maintenance savings. There is also an intangible benefit of lesser wear on the TREP conditioners due to lesser heat generated. It was estimated that the fixed cost of TREP flotation may be reduced by half if all the conditioners are utilized thus doubling the capacity of a TREP plant.

DESCRIPTION OF PREFERRED EMBODIMENTS

The process of the invention is applicable to the benefaction of a variety of kaolin clay containing a colored titania impurity, usually in anatase crystalline form. The particles of impurity are usually associated with small amounts of ferruginous matter. Typically, the color of the impurity is yellowish and may be brown. Generally, the impure clay has a yellowish or cream color. The $TiO_2$ content of the kaolin is usually in the range of about 1% to 2% by weight. Iron content, expressed as $Fe_2O_3$ is usually in the range of about 0.2% to 0.5% by weight. All weights as reported herein are based on the dry weight of the kaolin. With most kaolins the titania impurity is concentrated in the finer particles of the kaolin in the ore pulp to be treated. This tends to make purification by selective flotation a difficult operation because the finer particles of the kaolin tend to be more prone to float and, thus, interfere with the desired high degree of selective flotation of the impurities.

As in other kaolin flotation processes, it is normal practice to remove grit and oversize e.g., particles larger than 325 mesh (Tyler) before the conditioning and froth flotation take place. The crude are crushed and then blunged in water to facilitate degritting. Generally, blunging takes place at solids in the range of about 30% to 50%.

For reasons of economy, we prefer to operate with aqueous pulps of crushed degritted crudes that have not been prefractionated to isolate a desired particle size fraction of the clay. Such kaolins are generally referred to as "whole" crudes although grit has been removed. By operating with whole crudes, we avoid dilution with water, as generally required to fractionate kaolins. The psd of the degritted coarse white crude from central Gerogia is typically in the range of 55–65% finer than 2 $\mu$m.

After blunging, it is necessary to add a clay dispersant to the pulp of impure clay. Recommended is sodium silicate, typically one having a modulus ($SiO_2/Na_2O$) above 2, usually in the range of 2.5 to 3.5. N BRAND® sodium silicate has been used successfully. The amount of sodium silicate required will vary with the nature of the crude as well as the solids and pH of the slurry. Typically, the quantity of sodium silicate is in the range of about 0.05% to 0.5%, based on the weight of dry feed. Preliminary testing showed that use of sodium silicate converted to hydrosol form, preferably an alum-silicate hydrosol, give better results in terms of recovery of the beneficiated clay. The preparation of alum-silicate hydrosols and their use in froth flotation of kaolins is known in the art. The amount of hydrosol used is typically 0.05–0.5%. The amount of hydrosol required for TREP is roughly twice the amount that is required for Ultraflotation because the pH of the float feed for the latter is adjusted with soda ash which, in turn, requires lesser dispersant. Polyacrylates can also be used as the primary dispersant with hydroxamate collector unlike the calcium chloride-oleic acid chemistry.

Addition of dispersant results in a perceptible increase in fluidity of the pulp. At this point of the process, solids of aqueous pulp of degritted whole crude is usually in the range of 25% to 45%, preferably 30% to 40%, and most preferably 35% to 40%. Operation at the maximum solids consistent with fluidity required for handling the pulp, is recommended because this is a cost effective way for handling and transportation to the plant site from the mine site and reduces the energy demand per ton of solids on conditioning. The pH of the dispersed pulp is typically in the range of 4.0 to 7.0 unless pH adjustment prior to dispersion has been carried out.

Before or after addition of dispersant, preferably after, the pH of the pulp is adjusted to a value in the range of 6.0 to 8.5, preferably in the range of 6.5 to 8.0, and most preferably about 7. Sodium hydroxide is preferably used for pH adjustment although potassium or ammonium hydroxide can be employed. Illustrative examples herein demonstrate the dramatic effect of pH on flotation when practicing this invention. By operating with a substantially neutral pulp, recovery and product purity are enhanced when compared to results reported by Yoon et al in the '556 patent.

It should be noted that in practice of the flotation process of Yoon, as described in U.S. Pat. No. 4,629,556, Yoon et al, preferred flotation pH using an hydroxamate collector is within the range of 8–10.5. The use of pH above 6 is broadly disclosed, but no examples of pH values below 10 are reported.

The dispersed pulp of impure kaolin clay is transferred to a conditioning vessel (or vessels) prior to passage through a flotation cell, usually a battery of flotation cells. To obtain the benefits of the invention, the conditioning vessel must be a high intensity mill capable of increasing the temperature of the pulp, initially at about 50° F. to 80° F. to a value of at least 130° F. and below the boiling point. Preferably sufficient energy is imparted to increase temperature to a value ranging from about 130° F. to 170° F., preferably in the range of about 130° F. to 150° F., and most preferably in the range of 140° F. to 150° F. The energy imparted to the pulp to increase temperature calculates to values in the range of 25 to 100 hp.hr/ton, preferably 50 to 75 hp.hr/ton. Operation with energy input at the minimum level consistent with desired flotation response is obviously desired to reduce costs associated with process. Also, wear on equipment may be minimized.

Any agitated equipment provided with mechanical means to increase pulp temperature can be used in the conditioning step. Recommended is the squirrel cage conditioner described in U.S. Pat. No. 4,483,624, Bacon et al, the teachings of which are incorporated herein in full by cross-reference thereto. We have found that heating the pulp by means other than use of mechanical agitation will not suffice. For example, heating the conditioner feed to 130° F. by placing the conditioner cell in a hot water bath and then conditioning with the hydroxamate collector using the Premier Dispersator resulted in a significant decrease in the recovery of purified kaolin.

The flotation collector added to the dispersed pulp during the conditioning step is an anionic hydroxamate, preferably added as the alkali metal salt, preferably sodium salt. Most preferably the hydroxamate is added as a solution in a higher fatty alcohol, such as dodecyl alcohol. The $pK_a$ of hydroxamic acid is reported to be about 9±0.5 in water. Pradip and Fuerstenau (1984) noted that the hydroxamate adsorption and flotation peaks around the $pK_a$ of hydroxamic acid. Around the $pK_a$ of the collector the co-adsorption of neutral hydroxamate species may occur together with the chemisorbed hydroxamate anions. It is quite probable that the maximum in flotation recovery and adsorption of hydroxamates is due to the enhanced activity of hydroxamate at the surface as a result of this ion/molecule adsorption, both of which can form stable metal chelates. Yoon (U.S. Pat. No. 4,662,559) also indicated 8.5–9.5 to be the optimum range for beneficiation of kaolin crude via flotation. Further, Pradip and Fuerstenau pointed out enhanced flotation response with increasing temperature. This invention, on the contrary, showed enhanced flotation response with temperature at lower pH than suggested to be optimum thus far.

Sodium octyl hydroxamate is commercially available from Cytec Industries as S6493 and is suitable for use in practice of this invention. This material is readily dispersible in water in mildly alkaline circuits according to Cytec Industries technical literature. However, we were successfully able to use it under slightly acidic conditions with the TREP conditioner. The potassium salt is expected to perform equally well. Sodium octyl hydroxamate is commercially available from Cytec Industries as S6493 and is suitable for use in practice of this invention. The potassium salt is expected to perform equally well.

The quantity of hydroxamate flotation collector required will vary with the crude characteristics and slurry solids and pH and in the present invention is generally in the range of 0.5–1.5 lb/ton, preferably about 0.75–1.0 lb/ton calculated on the active content of hydroxamate in the reagent and based on dry weight of the clay in the pulp. When too little collector is used the product TiO2 and hence GEB are less than desired. When too much collector is used the recovery of kaolin and the process economics are adversely affected. Normally it is not necessary to add a frother. When used it should be added after conditioning.

The conditioned pulp, while still hot, for example at a temperature above 120° F., preferably 130° F. or above, is transferred to a flotation cell for aeration and flotation. Usually a battery of cells operated in series is used. The flotation cells must be capable of handling pulps at the relatively high solids preferably used in practice of this invention. The conditioning time is such as to allow liberation of the $TiO_2$ particles from kaolin and attachment of hydroxamate to the $TiO_2$ particles. The conditioning time in the present invention will vary with the crude characteristics, slurry solids and pH. Higher pulp solids will require less conditioning time and at a given solids the conditioning time will be dependent on the amount of TiO2 that needs to be removed. The conditioning time in the present invention generally varies from 8–30 minutes, preferably 10–25 minutes and most preferably 15–25 minutes.

Excellent results were achieved upon scale up from laboratory Denver cell to the flotation cells shown and described in U.S. Pat. No. 4,492,628, Young et al, the teachings of which are incorporated herein in full by cross-reference thereto. Such cells feature the introduction of air bubbles upwardly through a continuous countercurrently flow of clay slurry. Recycling is practiced by use of the flotation cells in series although more than two cells are seldom required with optimum conditioning. In case of calcium chloride-oleic acid flotation, typically four such cells are used.

Preferably, salt activators are not added during the flotation step. In contrast to the process of U.S. Pat. No. 4,492,628 (which uses a fatty acid collector with salt activator, preferably calcium), salt activators are not used.

During the froth flotation step, the froth product which is a concentrate of colored titaniferous impurities is removed from the pulp of purified kaolin clay. The solids of the purified kaolin will vary, depending on the initial solids and extent of dilution used to facilitate materials handling. Typically solids are in the range of 30–35% solids.

The aqueous pulp of purified kaolin clay is recovered from the flotation cells in the form of a fluid dispersion. Conventional post-processing steps can then be utilized. For example, the purified kaolin can be flocculated by addition of acid or alum, bleached with a reductive bleach such as sodium dithionite, filtered and washed. Other steps such as magnetic purification can be added, usually before bleaching.

Recovery of purified kaolin is greater than 80% by weight [based on the dry weight of flotation feed], preferably at least 85% by weight, and most preferably, at least 90%. Clay brightness after flotation, fractionation and bleaching is greater than 90% (using the known GE test). Residual titania in the purified kaolin will vary with specific kaolin being treated and is preferably less than 0.6%, preferably less than 0.5% and, most preferably less than 0.4%. Residual $Fe_2O_3$ level is typically less than 0.4%, preferably less than 0.35% and, most preferably less than 0.3%.

In the following examples, the kaolin crudes were from central Georgia and were of the "soft" crude type. Typical particle size distribution of degritted pulps of such crudes was 55–65% finer than 2 $\mu$m. $TiO_2$ and iron analyses varied in the tests. Generally $TiO_2$ contents were approximately 1.7% by weight. Iron content was about 0.3% by weight.

In the following illustrative Example 7, the silicate hydrosol was prepared by mixing alum and sodium silicate solutions prepared by the following protocol:

1. Alum solution—5 g of alum (dry basis) is dissolved into 495 g of water to make 500 g of alum solution.

2. Sodium silicate solution—57.5 g of the sodium silicate (3.22 modulus) solution at 38.6% solids is added to 1080 g of water to make 1137.5 g sodium silicate solution.
3. The alum solution and sodium silicate solutions prepared in steps 1 and 2 respectively are mixed to give the hydrosol solution. The alum solution is added to the sodium silicate solution and the mixing is gradual during the addition process.

In the examples the S6493 hydroxamate consists predominantly of 8 carbon hydroxamate and a minor component of 10 carbon hydroxamate dissolved in dodecylalcohol. The solution contained 30% by weight hydroxamate; balance was alcohol solvent. The general formula for hydroxamate collector molecule is:

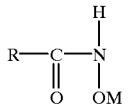

in which R is an alkyl, aryl or alkyaryl group having 4–28 C atoms and M is hydrogen, an alkali metal or an alkaline earth metal. The dodecylalcohol matrix in case of S6493 was selected to minimize frothing.

In the examples, unless otherwise indicated conditioning was conducted in a laboratory model squirrel cage conditioner, referred to in the examples as a TREP conditioner.

In all examples, after the flotation was completed, a portion of the beneficiated kaolin product was used to measure the slurry density from which the kaolin recovery was determined. Another portion of the product was used to determine the residual $TiO_2$ content via X-ray Fluorescence on an ASOMA machine.

EXAMPLE 1

The example shows the effect of pH on TiO2 removal using a hydroxamate collector in TREP flotation.

Crude kaolin, with a TiO2 content of 1.64%, from a mill in Washington County, Georgia was blunged with N-Brand sodium silicate (3#/t dry basis) using a drill press (1600 rpm with an Inco Type D blade) and blunger bucket at about 45% solids. The resultant slurry was degritted using a 200 mesh [Tyler] screen. The psd of the feed slurry was such that 62% of the particles (by weight) were less than 2 $\mu$m. The slurry was diluted to 36% solids following which the pH was adjusted to desired value with sodium hydroxide. Hydroxamate reagent S-6493 at 2.0 #/t (as received and with a hydroxamic acid content of about 30% and added on dry clay basis) was added to the slurry using a laboratory mixer (500 rpm with a propeller blade) for 5 minutes to ensure uniform mixing of the reagent. The slurry was then transferred to a laboratory model TREP conditioner. During the conditioning process a thermometer was inserted into the kaolin slurry to monitor the temperature. The conditioning time used was that necessary to achieve a temperature of 130° F. The conditioned slurry was transferred to a Denver flotation machine [Model 533000] operating at 1200 rpm. Flotation was performed for 20 minutes during which water was squirted into the pulp to maintain the level of the pulp in the flotation cell. The results are summarized in Table 1. In this table the GE Brightness (GEB), $TiO_2$ and $Fe_2O_3$ contents are those of the beneficiated clay products.

TABLE 1

| TEST | Feed pH | CYTEC 6493, #/T | COND. TEMP. ° F. | COND. SOLIDS, % | GEB % | TiO2, % | Fe2O3, % | PROD YIELD, % |
|---|---|---|---|---|---|---|---|---|
| 1. | 7.0 | 2.0 | 130 | 36 | 85.7 | 0.706 | 0.28 | 80 |
| 2. | 8.5 | 2.0 | 130 | 36 | 85.3 | 0.828 | 0.29 | 80 |
| 3. | 10.0 | 2.0 | 130 | 36 | 84.5 | 1.12 | 0.29 | 87 |

Data in Table 1 show that flotation with hydroxamate collector improves with decreasing pH and was optimum at pH 7.0 taking into account both yield of purified clay and titania removal from the starting clay.

EXAMPLE 2

This example shows the effect of pH and conditioning time on removal of TiO2 with an hydroxamate reagent.

Crude kaolin, with a TiO2 content of 1.64% used in Example 1, was blunged with sodium silicate (3#/t dry basis) [N Brand] using a drill press (1600 rpm with an Inco Type D blade) and blunger bucket at about 60% solids. The resultant slurry was degritted using a 200 mesh screen. The slurry was diluted to 50% solids following which the pH was adjusted to a desired value with sodium hydroxide. Hydroxamate reagent S-6493 at 2.0 #/t (as received and with a hydroxamic acid content of about 30% and added on dry clay basis) was added to the slurry under a laboratory mixer (500 rpm with a propeller blade) for 5 minutes to ensure uniform mixing of the reagent. The slurry was then transferred to the laboratory TREP conditioner. During the conditioning process a thermometer was inserted into the kaolin slurry to monitor the temperature. The conditioning was conducted for seven minutes or forty minutes. The slurry was transferred to a Denver flotation machine [Model 533000] operating at 1200 rpm. Flotation was performed for 20 minutes during which water was squirted into the pulp to maintain the level of the pulp in the flotation cell level. The results are summarized in Table 2.

TABLE 2

| TEST | Feed pH | CYTEC 6493, #/T | COND. TEMP. ° F. | COND. TIME (min) | COND. SOLIDS, % | GEB | TiO2, % | Fe2O3, % | PROD YIELD, % |
|---|---|---|---|---|---|---|---|---|---|
| 1. | 7.0 | 2.0 | 95 | 7.0 | 50 | 85.1 | 0.907 | 0.28 | 80 |
| 2. | 10.0 | 2.0 | 95 | 7.0 | 50 | 84.4 | 1.03 | 0.29 | 87 |

TABLE 2-continued

| TEST | Feed pH | CYTEC 6493, #/T | COND. TEMP. ° F. | COND. TIME (min) | COND. SOLIDS, % | GEB | TiO2, % | Fe2O3, % | PROD YIELD, % |
|---|---|---|---|---|---|---|---|---|---|
| 2. | 7.0 | 2.0 | 167 | 40.0 | 50 | 86.4 | 0.549 | 0.29 | 92 |
| 3. | 10.0 | 2.0 | 167 | 40.0 | 50 | 84.3 | 1.11 | 0.29 | 90 |

Data in Table 2 show that there is a dramatic improvement in TiO2 removal with increase in conditioning time at pH 7.0. On the other hand, the flotation response at pH 10.0 remains unchanged with conditioning time contrary to that reported in literature.

EXAMPLE 3

This example demonstrates the effect of reagent chemistry on conditioning time in TREP.

The same crude kaolin used in Examples 1 & 2 (TiO2 content of 1.64%) was blunged with sodium silicate (3#/t dry basis) using a drill press (1600 rpm with an Inco Type D blade) and blunger bucket at about 45% solids. In accordance with this invention, the resultant slurry was degritted using a 200 mesh screen. The slurry was diluted to 36% solids following which the pH was adjusted to 7.0 with sodium hydroxide. Hydroxamate reagent S-6493 at 3.0 #/t (as received and with a hydroxamic acid content of about 30% and added on dry clay basis) was added to the slurry under a laboratory mixer (500 rpm with a propeller blade) for 5 minutes to ensure uniform mixing of the reagent. The slurry was then transferred to the laboratory TREP conditioner. During the conditioning process a thermometer was inserted into the kaolin slurry to monitor the temperature. The conditioning was done to a targeted temperature and the duration of conditioning in reaching this temperature was noted. The slurry, while still close to conditioning temperature was transferred to a Denver flotation machine operating at 1200 rpm. Flotation was performed for 20 minutes during which water was squirted into the pulp to maintain the level of the pulp in the flotation cell.

For purposes of comparison with the prior art TREP process, the same crude was degritted as described above and diluted to 40% solids. The pH of the slurry was adjusted to 7.5. Thereafter, the slurry was treated with 2.5#/t calcium chloride (dry basis) followed by oleic acid at 0.75 #/t under a laboratory mixer (500 rpm with a propeller blade) for 5 minutes to ensure uniform mixing of the reagent. The slurry was then transferred to the laboratory TREP conditioner. During the conditioning process a thermometer was inserted into the kaolin slurry to monitor the temperature. The conditioning was done until a temperature of 200° F. was achieved and the duration of conditioning in reaching this temperature was noted. The slurry was transferred to a Denver flotation machine operating at 1200 rpm. Flotation was performed for 20 minutes during which water was squirted into the pulp to maintain the flotation cell level.

TABLE 3

| TEST | Feed pH | CYTEC 6493, #/T | COND. TEMP. ° F. | COND. TIME (min) | COND. SOLIDS, % | GEB | TiO2, % | Fe2O3, % | PROD YIELD, % |
|---|---|---|---|---|---|---|---|---|---|
| 1* | 7.5 | 2.5/.75 | 200 | 80 | 40 | 86.7 | 0.510 | .26 | 86 |
| 2 | 7.0 | 3.0 | 130 | 20 | 36 | 86.8 | 0.471 | .30 | 84 |

*indicates the TREP control sample and the use of 2.5#/t $CaCl_2$ and .75#/t oleic acid.

Data in Table 3 show that the substitution of hydroxamate reagent for oleic acid as the collector results in about 75% reduction in conditioning time and hence conditioning energy.

EXAMPLE 4

This example shows the effect of solids on TiO2 removal with hydroxamate in the TREP flotation process.

A degritted kaolin slurry was obtained from a commercial TREP plant. In this kaolin feed $TiO_2$was 1.712%. The degritted slurry was prepared by blunging the crude with an alum/silicate hydrosol (typically 1#/t on dry basis) at the commercial mill and passing the slurry through a series of hydrocyclones and screens to remove the grit. The pH on the as-received slurry was adjusted to 7.0 with sodium hydroxide. Hydroxamate reagent S-6493 at 2.75 #/t (as received and with a hydroxamic acid content of about 30% and added on dry clay basis) was added to the slurry under a laboratory mixer (500 rpm with a propeller blade) for 5 minutes to ensure uniform mixing of the reagent. The slurry was then transferred to the laboratory TREP conditioner. During the conditioning process a thermometer was inserted into the kaolin slurry to monitor the temperature. The conditioning was done to achieve a temperature of 150° F. and the duration of conditioning in reaching this temperature was noted. The slurry was transferred to a Denver flotation machine (commercial or laboratory scale machine) operating at 1200 rpm. Flotation was performed for 20 minutes during which water was squirted into the pulp to maintain the level of the pulp in the flotation cell. The results are summarized in Table 4.

A portion of the as received slurry was diluted to 27% solids following which the pH was adjusted to 7.0 with sodium hydroxide. Hydroxamate reagent S-6493 at 2.75 #/t (as received and with a hydroxamic acid content of about 30% and added on dry clay basis) was added to the slurry under a laboratory mixer (500 rpm with a propeller blade) for 5 minutes to ensure uniform mixing of the reagent. The slurry was then transferred to the laboratory TREP conditioner. During the conditioning process a thermometer was inserted into the kaolin slurry to monitor the temperature. The conditioning was done to achieve a temperature of 150° F. and the duration of conditioning in reaching this temperature was noted. The slurry was transferred to a Denver flotation machine operating at 1200 rpm. Flotation was performed for 20 minutes during which water was squirted into the pulp to maintain the level of the pulp in the flotation cell.

After the flotation was completed, a portion of the beneficiated kaolin product was used to measure the slurry density from which the kaolin recovery was determined. Another portion of the product was used to determine the residual TiO2 content via X-ray Fluorescence on an ASOMA machine. Results for this test are all reported in Table 4.

TABLE 4

| TEST | Feed pH | CYTEC 6493, #/T | COND. TEMP. ° F. | COND. SOLIDS, % | TiO2, % | Fe2O3, % | PROD. YIELD, % |
|---|---|---|---|---|---|---|---|
| 1. | 7.0 | 2.75 | 150 | 35 | 0.372 | 0.336 | 83 |
| 2. | 7.0 | 2.75 | 150 | 27 | 0.446 | 0.346 | 81 |

Data in Table 4 show that inspite of relatively low solids, e.g., 27% as compared to 35%, the titania removal and clay yield were at commercially viable levels.

EXAMPLE 5

This example shows the effect of extensive (TREP) conditioning versus regular conventional [relatively low energy] conditioning in $TiO_2$ removal by flotation at pH7.0.

Crude kaolin, with a $TiO_2$ content of 1.64%, from a mill in Washington County, Georgia was blunged with [N Brand] sodium silicate (3#/t dry basis) using a drill press (1600 rpm with an Inco Type D blade) and blunger bucket at about 45% solids. The resultant slurry was degritted using a 200 mesh screen. The slurry was diluted to 36% solids following which the pH was adjusted to desired pH with sodium hydroxide. Hydroxamate reagent S-6493 at 3.0 #/t (as received and with a hydroxamic acid content of about 30% and added on dry clay basis) was added to the slurry under a laboratory mixer (500 rpm with a propeller blade) for 5 minutes to ensure uniform mixing of the reagent. The slurry was then transferred to the laboratory TREP conditioner. During the conditioning process a thermometer was inserted into the kaolin slurry to monitor the temperature. The conditioning was done to achieve a temperature of 130 F. The slurry was transferred to a Denver flotation machine operating at 1200 rpm. Flotation was performed for 20 minutes during which water was squirted into the pulp to maintain the flotation cell level.

For purposes of comparison, a portion of the degritted slurry diluted to 36% solids was taken and the pH was adjusted to 7.0 with sodium hydroxide. Hydroxamate reagent S-6493 at 2.75 #/t (as received and with a hydroxamic acid content of about 30% and added on dry clay basis) was added to the slurry under a laboratory mixer (500 rpm with a propeller blade) for 5 minutes to ensure uniform mixing of the reagent. The slurry was then conditioned with Premier Dispersator (a high speed mixer from Premier Mill Corp.) at about 6000 rpm for 20 minutes and the temperature of the slurry measured. The slurry was transferred to a Denver flotation machine operating at 1200 rpm. Flotation was performed for 20 minutes during which water was squirted into the pulp to maintain the level of the pulp in the flotation cell level. The results are summarized in Table 5.

TABLE 5

| TEST | Feed pH | CYTEC 6493, #/T | COND. TEMP. ° F. | COND. SOLIDS, % | GEB | TiO2, % | Fe2O3, % | PROD. YIELD, % |
|---|---|---|---|---|---|---|---|---|
| 1. | 7.0 | 3.0 | 130 | 36 | 86.8 | 0.471 | 0.30 | 84 |
| 2.** | 7.0 | 3.0 | 68 | 36 | 83.6 | 0.706 | 0.35 | 74 |

**indicates high speed blunging @ 6000 rpm using a Premier Dispersator.

Data in Table 5 show that at pH 7 using conventional low intensity conditioning there was removal of TiO2 at 36% solids but because of low pH the residual TiO2 exceeded a commercially viable level of less than about 0.5%. Under the same conditions a clay product with better recovery and commercially viable residual TiO2 was obtained by conditioning in the TREP conditioner.

EXAMPLE 6

This example shows the effect of aging a dispersed kaolin slurry prior to conditioning with hydroxamate reagent using the TREP process.

Crude kaolin, with a TiO2 content of 1.79%, from a commercial mill in Washington County, Georgia was blunged with sodium silicate (3#/t dry basis) using a drill press (1600 rpm with an Inco Type D blade) and blunger bucket at about 50% solids. The resultant slurry was degritted using a 200 mesh screen. The slurry was diluted to 45% solids following which the pH was adjusted to 7.0 with sodium hydroxide. Hydroxamate reagent S-6493 at 2.75 #/t (as received and with a hydroxamic acid content of about 30% and added on dry clay basis) was added to the slurry under a laboratory mixer (500 rpm with a propeller blade) for 5 minutes to ensure uniform mixing of the reagent. The slurry was then transferred to the laboratory TREP conditioner. During the conditioning process a thermometer was inserted into the kaolin slurry to monitor the temperature. The conditioning was done to achieve a temperature of 130 F. The slurry was transferred to a Denver flotation machine operating at 1200 rpm. Flotation was performed for 20 minutes during which water was squirted into the pulp to maintain the level of the pulp in the flotation cell.

The same degritted slurry adjusted to 45% solids was aged for four days following which sodium hydroxide was added to adjust the pH to 7.0. Hydroxamate reagent S-6493 was added to the slurry under a laboratory mixer (500 rpm with a propeller blade) for 5 minutes to ensure uniform mixing of the reagent. The slurry was then transferred to the laboratory TREP conditioner. During the conditioning process a thermometer was inserted into the kaolin slurry to monitor the temperature. The conditioning was done to achieve a temperature of 130 F. The slurry was transferred to a Denver flotation machine operating at 1200 rpm. Flotation was performed for 20 minutes during which water was squirted into the pulp to maintain the level of the pulp in the flotation cell.

The results are summarized in Table 6.

TABLE 6

| TEST | Feed pH | Age Time | CYTEC 6493, #/T | COND. TEMP. ° F. | COND. SOLIDS, % | TiO2, % | Fe2O3, % | PROD. YIELD, % |
|---|---|---|---|---|---|---|---|---|
| 1. | 7.0 | Same day | 2.75 | 130 | 45 | 0.472 | 0.28 | 80 |
| 2. | 7.0 | Fourdays | 2.75 | 130 | 45 | 0.421 | 0.29 | 83 |

Data in Table 6 show that aging does not have a negative influence on flotation with an hydroxamate collector. On the contrary, the data suggest that aging may help improve the flotation response.

EXAMPLE 7

The example shows the superiority of an alum-silicate hydrosol over sodium silicate when used to disperse a kaolin slurry for flotation for TREP flotation using an hydroxamate collector.

Crude from a commercial Washington County mill with a TiO2 of 1.79% was blunged with sodium silicate (3#/t dry basis and referred to as N-Brand® in Table 7) using a drill press (1600 rpm with an Inco Type D blade) and blunger bucket at about 45% solids. This slurry was degritted using a 200 mesh screen. The slurry was diluted to 40% solids following which the pH was adjusted to a preferred value of 7.0 with sodium hydroxide. Hydroxamate reagent S-6493 at 2.75 #/t (as received and with a hydroxamic acid content of about 30% and added on dry clay basis) was added to the slurry under a laboratory mixer (500 rpm with a propeller blade) for 5 minutes to ensure uniform mixing of the reagent. The slurry was then transferred to the laboratory TREP conditioner. During the conditioning process a thermometer was inserted into the kaolin slurry to monitor the temperature. The conditioning was done to achieve a temperature of 140 F. The slurry was transferred to a Denver flotation machine operating at 1200 rpm. Flotation was performed for 20 minutes during which water was squirted into the pulp to maintain the cell level.

The same crude was also blunged with an alum-silicate hydrosol (1#/t dry basis) using a drill press (1600 rpm with an Inco Type D blade) and blunger bucket at 45% solids. This slurry was degritted using a 200 mesh screen. The slurry was diluted to 40% solids following which the pH was adjusted to 7.0 with sodium hydroxide. Hydroxamate reagent S-6493 at 2.75 #/t (as received and with a hydroxamic acid content of about 30% and added on dry clay basis) was added to the slurry under a laboratory mixer (500 rpm with a propeller blade) for 5 minutes to ensure uniform mixing of the reagent. The slurry was then transferred to the laboratory TREP conditioner. During the conditioning process a thermometer was inserted into the kaolin slurry to monitor the temperature. The conditioning was done to achieve a temperature of 140 F. The slurry was transferred to a Denver flotation machine (Model 533000) operating at 1200 rpm. Flotation was performed for 20 minutes during which water was squirted into the pulp to maintain the cell level.

The results of the testing are summarized in Table 7.

TABLE 7

| TEST | Feed pH | Dispersant | CYTEC 6493, #/T | COND. TEMP. ° F. | COND. SOLIDS, % | TiO2, % | Fe2O3, % | PROD. YIELD, % |
|---|---|---|---|---|---|---|---|---|
| 1. | 7.0 | N-Brand ® Sodium silicate | 2.75 | 140 | 40 | 0.508 | 0.29 | 67 |
| 2. | 7.0 | Hydrosol - Alum silicate | 2.75 | 140 | 40 | 0.338 | 0.29 | 70 |

Date in Table 7 show that hydroxamate collector was considerably more efficient with usage of a hydrosol dispersant than the sodium silicate.

By way of summary, the foregoing examples clearly show that:

(1) The substitution of the conventional calcium chloride-oleic chemistry by the hydroxamate reagent results in a very significant reduction in the conditioning time by about 75%. This implies a reduction in the conditioning energy by 75% and higher productivity or lower maintenance costs through usage of hydroxamate reagent. Further the reagent scheme is simplified in that the three chemicals—calcium chloride, oleic acid and sodium polyacrylate- are replaced by one reagent—hydroxamate.

(2) The usage of hydroxamate with a TREP conditioner led to a decrease in both conditioning and flotation time when compared to teachings of Yoon. The hydroxamate chemistry was effective at high temperatures and at significantly lower solids than reported by Yoon.

(3) The benefits of this invention require pH values lower than those recommended by Yoon et al.

We claim:

1. The method for treating kaolin clay to remove particles of titanium mineral impurities therefrom which comprises the steps of:

(a) mixing said kaolin clay with said impurities with water and a clay dispersant selected from the group consisting of sodium silicate and an alum-silicate hydrosol using sufficient water and dispersant to provide a fluid slurry having a solid content of at least 25%, (b) adjusting the pH of the slurry from step (a) to a value in the range of 6 to 9, (c) adding to said fluid slurry a hydroxamate flotation collector, (d) conditioning the slurry from step (c) using sufficient mechanical energy to raise the temperature of the conditioned slurry to about 130° F. to 170° F.

(e) introducing air bubble to the heated conditioned slurry from step (d) thereby producing a froth which is a concentrate of particles of titania impurities, removing said froth from the remainder of said slurry which is a concentrate of kaolin clay having a reduced content of particles of titania impurities in the form of a fluid dispersed slurry and (f) recovering said concentrate of purified kaolin clay having a reduced content of particles of titania impurities.

2. The method of claim 1 wherein the temperature in step (d) is in the range of about 130° F. to 150° F.

3. The method of claim 1 wherein said dispersant is sodium silicate.

4. The method of claim 1 wherein said dispersant is an alum-silicate hydrosol.

5. The method of claim 1 wherein said hydroxamate collector is a salt that has the formula

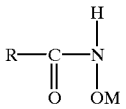

in which R is an alkyl or aryl or alkylaryl group having from 4 to 28 carbon atoms and M is hydrogen, an alkali metal, or an alkaline earth metal and said hydroxamate salt is used as a solution in dodecylalcohol.

6. The method of claim 5 wherein said M is sodium and R contains from 8 to 12 carbon atoms.

7. The method of claim 1 wherein the sole dispersant is one added before addition of said hydroxamate collector.

8. The method of claim 1 wherein the pH in step (b) is in the range of 7 to 8.

9. The method of claim 1 wherein air is bubbled into said concentrate of kaolin clay from step (e) to remove additional impurities.

10. The method of claim 1 wherein step (d) is carried out by continuously passing air bubbles upwardly thru said slurry while passing said slurry downwardly through a flotation in which step (d) is carried out.

11. The method of claim 1 wherein conditioning in step (d) is carried out in a vessel comprising horizontal baffles in the interior thereof which divide the vessel in a plurality of chambers, each baffle containing a central, circular hole, inlet means for feeding a clay pulp to the lowermost chamber, outlet means for removing conditioned pulp from the space above the uppermost baffle; a rotatable vertical drive shaft centrally positioned to rotate in vessel and extending through each said hole in each said baffle; and a plurality of impellers each mounted for rotation said shaft, each of said impellers containing spaced apart vertical bars.

12. The method of claim 1 wherein the total residence time during conditioning is in the range of 5 to 30 minutes.

* * * * *